US007263480B2

(12) United States Patent
Minde et al.

(10) Patent No.: US 7,263,480 B2
(45) Date of Patent: Aug. 28, 2007

(54) MULTI-CHANNEL SIGNAL ENCODING AND DECODING

(75) Inventors: Tor Björn Minde, Gammelstad (SE); Tomas Lundberg, Luleå (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 899 days.

(21) Appl. No.: 10/380,419

(22) PCT Filed: Sep. 5, 2001

(86) PCT No.: PCT/SE01/01886

§ 371 (c)(1),
(2), (4) Date: Mar. 14, 2003

(87) PCT Pub. No.: WO02/23529

PCT Pub. Date: Mar. 21, 2002

(65) Prior Publication Data

US 2003/0191635 A1 Oct. 9, 2003

(51) Int. Cl.
*G10L 21/00* (2006.01)

(52) U.S. Cl. ..... 704/219; 704/500; 370/343

(58) Field of Classification Search ..... 704/219, 704/500; 370/343
See application file for complete search history.

(56) References Cited

U.S. PATENT DOCUMENTS 5,121,385 A * 6/1992 Tominaga et al. ..... 370/435
5,436,899 A * 7/1995 Fujino et al. ..... 370/433

FOREIGN PATENT DOCUMENTS

| | | |
|---|---|---|
| EP | 0 858 067 | 8/1998 |
| EP | 0 875 999 | 11/1998 |
| EP | 0 878 798 | 11/1998 |
| WO | WO90/16136 | 12/1990 |
| WO | WO 00/19413 | 4/2000 |

* cited by examiner

*Primary Examiner*—Daniel Abebe
(74) *Attorney, Agent, or Firm*—Nixon & Vanderhye P.C.

(57) ABSTRACT

A multi-channel linear predictive analysis-by-synthesis signal encoding method determines (S1) a leading channel and encodes the leading channel as an embedded bitstream. Thereafter trailing channels are encoded as a discardable bitstream exploiting cross-correlation to the leading channel.

24 Claims, 6 Drawing Sheets

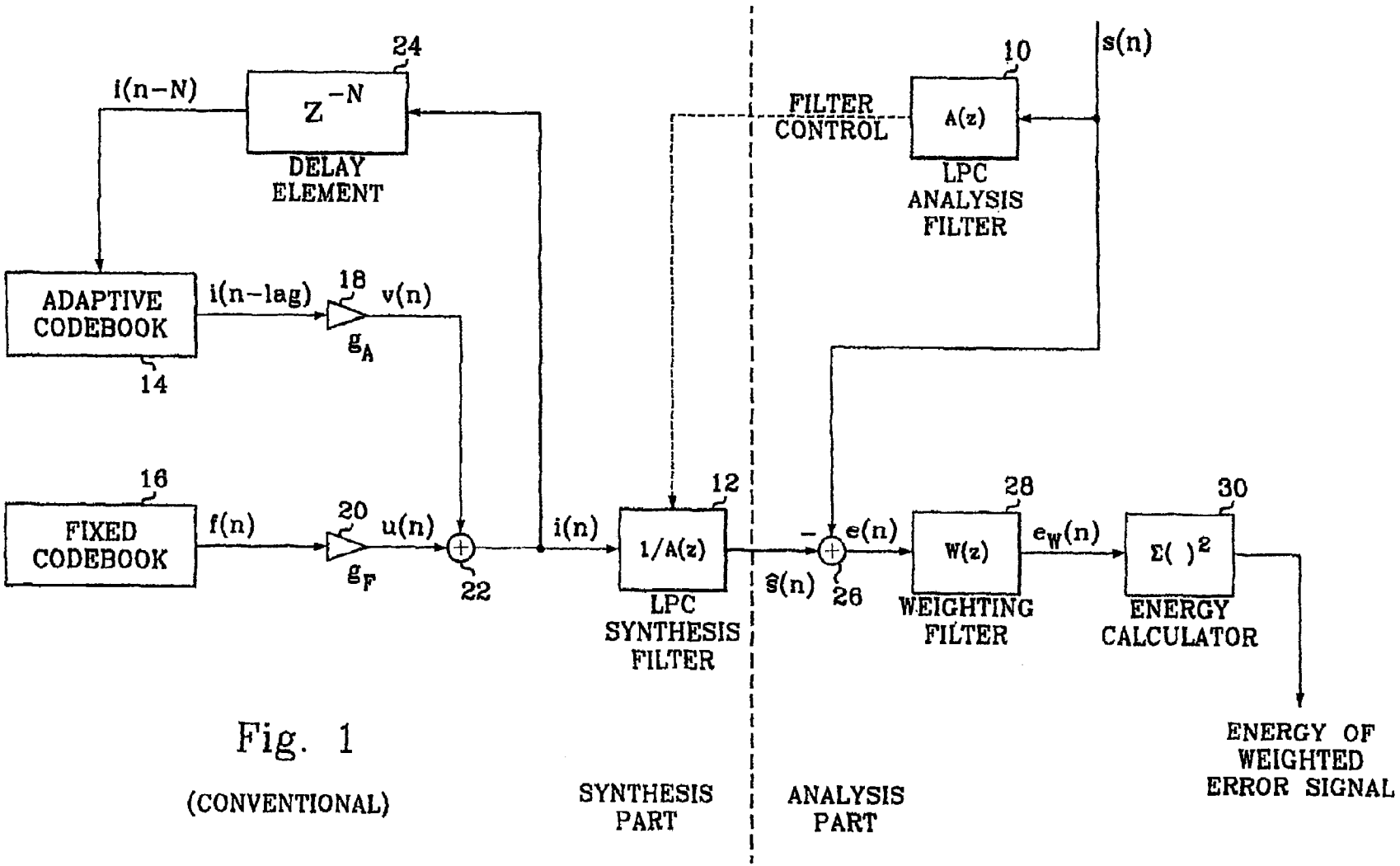
Fig. 1
(CONVENTIONAL)

MULTI-CHANNEL SIGNAL ENCODING AND DECODING

This application is the U.S. national phase of international application PCT/SE01/01886 filed 5 Sep. 2001 which designated the U.S..

TECHNICAL FIELD

The present invention relates to encoding and decoding of multi-channel signals, such as stereo audio signals.

BACKGROUND OF THE INVENTION

Conventional speech coding methods are generally based on single-channel speech signals. An example is the speech coding used in a connection between a regular telephone and a cellular telephone. Speech coding is used on the radio link to reduce bandwidth usage on the frequency limited air-interface. Well known examples of speech coding are PCM (Pulse Code Modulation), ADPCM (Adaptive Differential Pulse Code Modulation), sub-band coding, transform coding, LPC (Linear Predictive Coding) vocoding, and hybrid coding, such as CELP (Code-Excited Linear Predictive) coding [1-2].

In an environment where the audio/voice communication uses more than one input signal, for example a computer workstation with stereo loudspeakers and two microphones (stereo microphones), two audio/voice channels are required to transmit the stereo signals. Another example of a multi-channel environment would be a conference room with two, three or four channel input/output. This type of applications is expected to be used on the Internet and in third generation cellular systems.

In a communication system, the available gross bitrate for a speech coder depends on the ability of the different links. In certain situations, for example high interference on a radio link or network overload on a fixed link, the available bitrate may go down. In a stereo communication situation this means either packet loss/erroneous frames or for a multi-mode coder a lower bitrate for both channels, which in both cases means lower quality for both channels.

Another problem is the deployment of stereo capable terminals. All audio communication terminals implement a mono-channel, for example adaptive multi-rate (AMR) speech coding/decoding, and the fall-back mode for a stereo terminal will be a mono-channel. In a multi-party stereo conference (for example a multicast session) one mono terminal will restrict the use of stereo coding and higher quality due to need of interoperability.

General principles for multi-channel linear predictive analysis-by-synthesis (LPAS) signal encoding/decoding are described in [3]. However, the described coder is not flexible enough to cope with the described problems.

SUMMARY OF THE INVENTION

An object of the present invention is to find an efficient multi-channel LPAS speech coding structure that exploits inter-channel signal correlation and keeps an embedded bitstream.

Another object is a coder which, for an M channel speech signal, can produce a bit-stream that is on average significantly below M times that of a single-channel speech coder, while preserving the same or better sound quality at a given average bit-rate.

Other objects include reasonable implementation and computation complexity for realizations of coders within this framework.

These objects are solved in accordance with the appended claims.

Briefly, the present invention involves embedding a mono channel in the multi-channel coding bitstream to overcome the quality problems associated with varying gross bitrates due to, for example, varying link quality. With this arrangement, if there is a need to lower the gross bitrate, the embedded mono channel bitstream may be kept and the other channels can be disregarded. The communication will now "back-off" to mono coding operation with lower gross bitrate but will still keep a high mono-quality. The "stereo" bits can be dropped at any communication point and more channel coding bits can be added for higher robustness in a radio communication scenario. The "stereo" bits can also be dropped depending on the receiver side capabilities. If the receiver for one party in a multi-party conference includes a mono decoder, the embedded mono bitstream can be used by dropping the other part of the bitstream.

BRIEF DESCRIPTION OF THE DRAWINGS

The invention, together with further objects and advantages thereof, may best be understood by making reference to the following description taken together with the accompanying drawings, in which:

FIG. 1 is a block diagram of a conventional single-channel LPAS speech encoder;

DETAILED DESCRIPTION OF THE PREFERRED EMBODIMENTS

Figure 2:
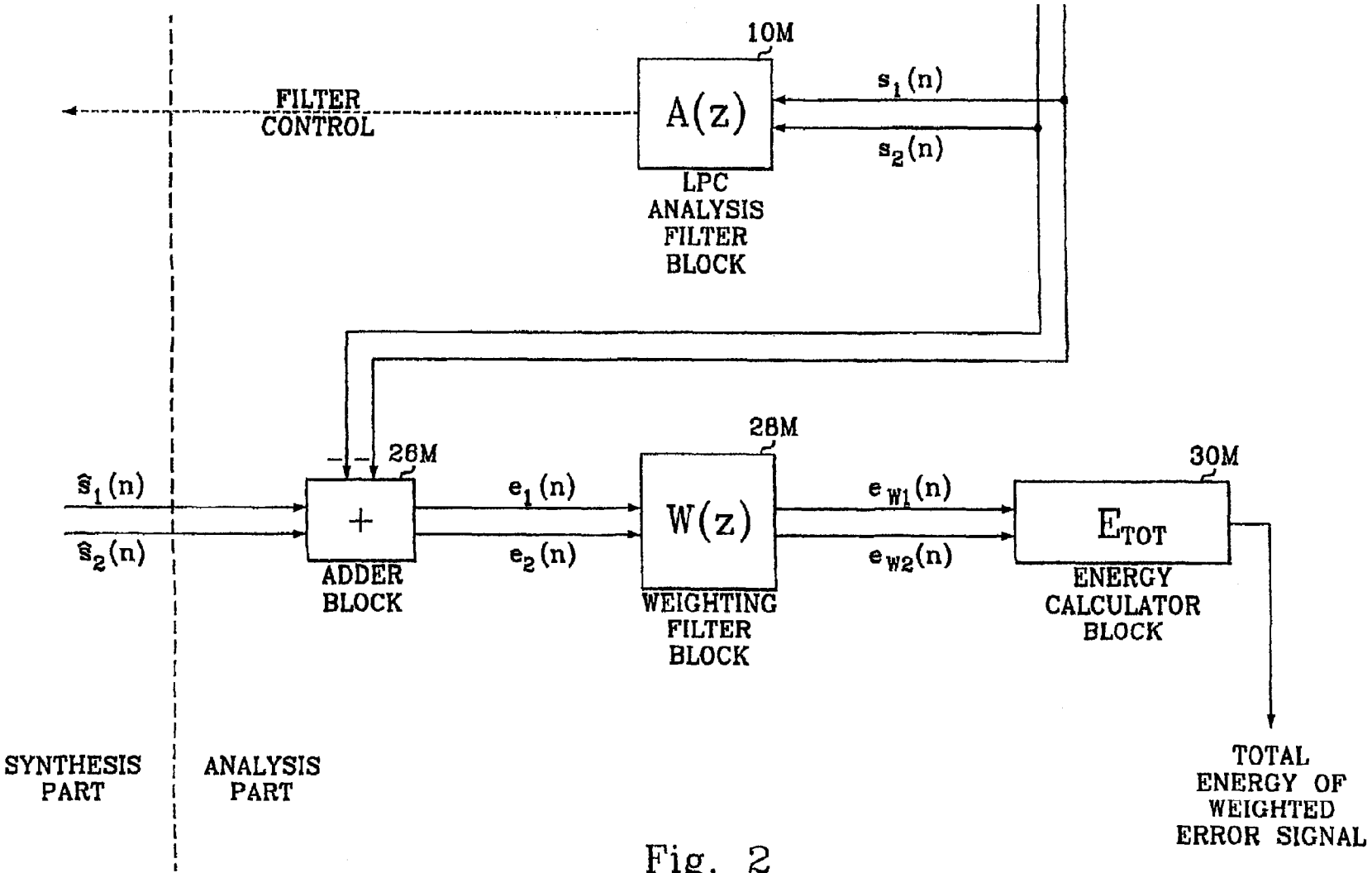
FIG. 2 is a block diagram of an embodiment of the analysis part of a prior art multi-channel LPAS speech encoder.

In the following description the same reference designations will be used for equivalent or similar elements.

The present invention will now be described by introducing a conventional single-channel linear predictive analysis-by-synthesis (LPAS) speech encoder, and a general multi-channel linear predictive analysis-by-synthesis speech encoder described in [3].

FIG. 1 is a block diagram of a conventional single-channel LPAS speech encoder. The encoder comprises two parts, namely a synthesis part and an analysis part (a corresponding decoder will contain only a synthesis part).

The synthesis part comprises a LPC synthesis filter 12, which receives an excitation signal i(n) and outputs a synthetic speech signal ŝ(n). Excitation signal i(n) is formed by adding two signals u(n) and v(n) in an adder 22. Signal u(n) is formed by scaling a signal f(n) from a fixed codebook 16 by a gain $g_F$ in a gain element 20. Signal v(n) is formed by scaling a delayed (by delay "lag") version of excitation signal i(n) from an adaptive codebook 14 by a gain $g_A$ in a gain element 18. The adaptive codebook is formed by a feedback loop including a delay element 24, which delays excitation signal i(n) one sub-frame length N. Thus, the adaptive codebook will contain past excitations i(n) that are shifted into the codebook (the oldest excitations are shifted out of the codebook and discarded). The LPC synthesis filter parameters are typically updated every 20-40 ms frame, while the adaptive codebook is updated every 5-10 ms sub-frame.

The analysis part of the LPAS encoder performs an LPC analysis of the incoming speech signal s(n) and also performs an excitation analysis.

The LPC analysis is performed by an LPC analysis filter 10. This filter receives the speech signal s(n) and builds a parametric model of this signal on a frame-by-frame basis. The model parameters are selected so as to minimize the energy of a residual vector formed by the difference between an actual speech frame vector and the corresponding signal vector produced by the model. The model parameters are represented by the filter coefficients of analysis filter 10.

These filter coefficients define the transfer function A(z) of the filter. Since the synthesis filter 12 has a transfer function that is at least approximately equal to 1/A(z), these filter coefficients will also control synthesis filter 12, as indicated by the dashed control line.

The excitation analysis is performed to determine the best combination of fixed codebook vector (codebook index), gain $g_F$, adaptive codebook vector (lag) and gain $g_A$ that results in the synthetic signal vector $\{\hat{s}(n)\}$ that best matches speech signal vector $\{s(n)\}$ (here { } denotes a collection of samples forming a vector or frame). This is done in an exhaustive search that tests all possible combinations of these parameters (sub-optimal search schemes, in which some parameters are determined independently of the other parameters and then kept fixed during the search for the remaining parameters, are also possible). In order to test how close a synthetic vector $\{\hat{s}(n)\}$ is to the corresponding speech vector $\{s(n)\}$, the energy of the difference vector $\{e(n)\}$ (formed in an adder 26) may be calculated in an energy calculator 30. However, it is more efficient to consider the energy of a weighted error signal vector $\{e_W(n)\}$, in which the errors has been re-distributed in such a way that large errors are masked by large amplitude frequency bands. This is done in weighting filter 28.

The modification of the single-channel LPAS encoder of FIG. 1 to a multi-channel LPAS encoder in accordance with [3] will now be described with reference to FIGS. 2-3. A two-channel (stereo) speech signal will be assumed, but the same principles may also be used for more than two channels.

FIG. 2 is a block diagram of an embodiment of the analysis part of the multi-channel LPAS speech encoder described in [3]. In FIG. 2 the input signal is now a multi-channel signal, as indicated by signal components $s_1(n)$, $s_2(n)$. The LPC analysis filter 10 in FIG. 1 has been replaced by a LPC analysis filter block 10M having a matrix-valued transfer function A(z). Similarly, adder 26, weighting filter 28 and energy calculator 30 are replaced by corresponding multi-channel blocks 26M, 28M and 30M, respectively.

Figure 3:
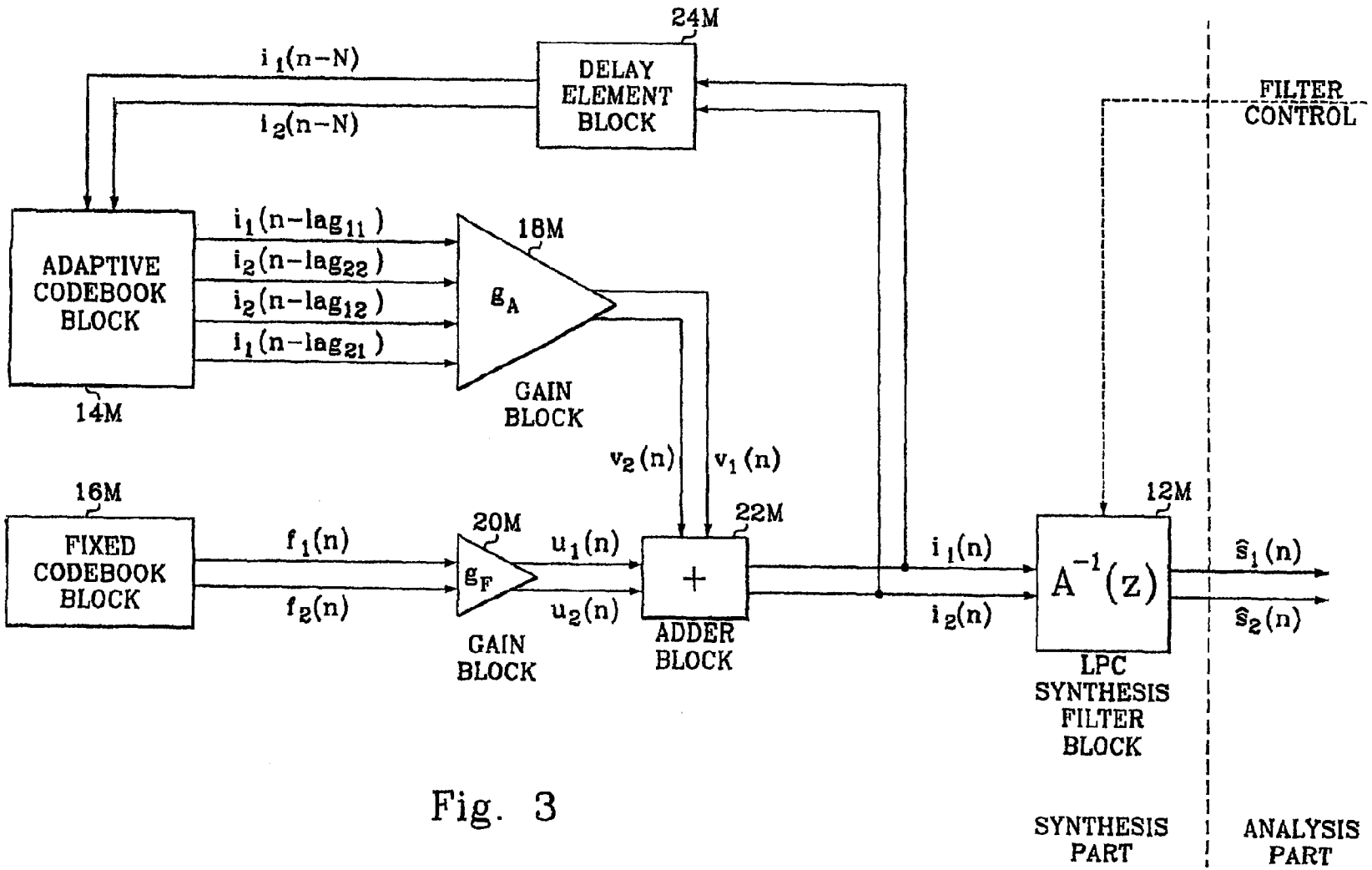
FIG. 3 is a block diagram of an embodiment of the synthesis part of a prior art multi-channel LPAS speech encoder.

FIG. 3 is a block diagram of an embodiment of the synthesis part of the multi-channel LPAS speech encoder described in [3]. A multi-channel decoder may also be formed by such a synthesis part. Here LPC synthesis filter 12 in FIG. 1 has been replaced by a LPC synthesis filter block 12M having a matrix-valued transfer function $A^{-1}(z)$, which is (as indicated by the notation) at least approximately equal to the inverse of A(z). Similarly, adder 22, fixed codebook 16, gain element 20, delay element 24, adaptive codebook 14 and gain element 18 are replaced by corresponding multi-channel blocks 22M, 16M, 24M, 14M and 18M, respectively.

The following description of an embedded multi-channel LPAS coder in accordance with the present invention will describe how the coding flexibility in the various blocks may be increased. However, it is to be understood that not all blocks have to be configured in the described way. The exact balance between coding flexibility and complexity has to be decided for the individual coder implementation.

Figure 4:
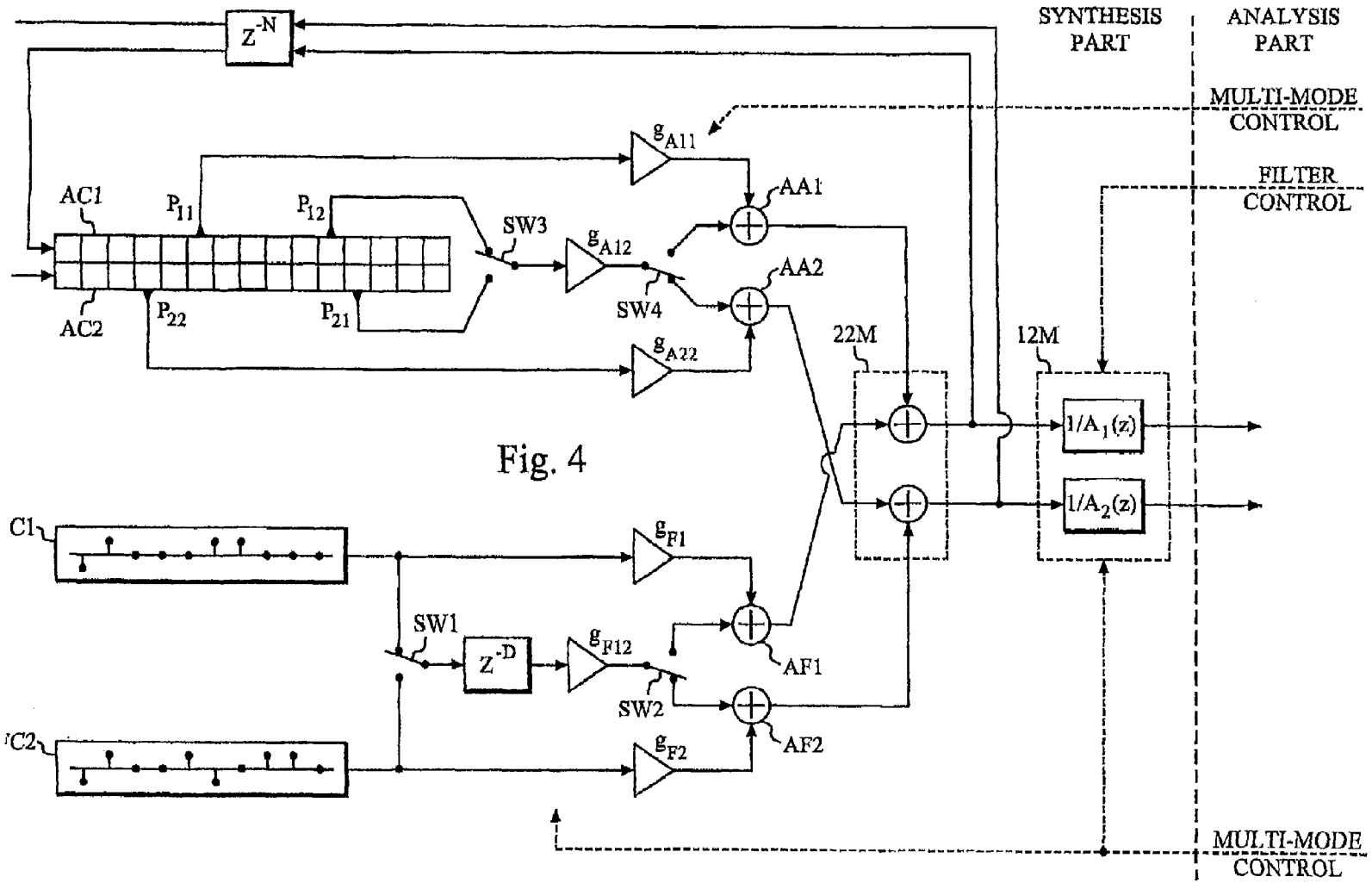
FIG. 4 is a block diagram of an exemplary embodiment of the synthesis part of a multi-channel LPAS speech encoder in accordance with the present invention.

FIG. 4 is a block diagram of an exemplary embodiment of the synthesis part of a multi-channel LPAS speech encoder in accordance with the present invention.

An essential feature of the coder is the structure of the multi-part fixed codebook. It includes individual fixed codebooks FC1, FC2 for each channel. Typically the fixed codebooks comprise algebraic codebooks, in which the excitation vectors are formed by unit pulses that are distributed over each vector in accordance with certain rules (this is well known in the art and will not be described in further detail here). The individual fixed codebooks FC1, FC2 are associated with individual gains $g_{F1}$, $g_{F2}$. An essential feature of the present invention is that one of the fixed codebooks, typically the codebook that is associated with the strongest or leading (mono) channel, may also be shared by the weaker or trailing channel over a lag or delay element D (which may be either integer or fractional) and an inter-channel gain $g_{F12}$.

In the ideal case, where each channel consists of a scaled and translated version of the same signal (echo-free room), only the shared codebook of the leading channel is required, and the lag value D corresponds directly to sound propagation time. In the opposite case, where inter-channel correlation is very low, separate fixed codebooks for the trailing channels are required.

With only one cross-channel branch in the fixed codebook, the leading and trailing channel has to be determined frame by frame. Since the leading channel may change, there are synchronously controlled switches SW1, SW2 to associate the lag D and gain $g_{F12}$ with the correct channel. In the configuration in FIG. 4, channel 1 is the leading channel and channel 2 is the trailing channel. By switching both switches SW1, SW2 to their opposite states, the roles will be reversed. In order to avoid heavy switching of leading channel, it may be required that a change is only possible if the same leading channel has been selected for a number of consecutive frames.

A possible modification is to use less pulses for the trailing channel fixed codebook than for the leading channel fixed codebook. In this embodiment the fixed codebook length will be decreased when a channel is demoted to a trailing channel and increased back to the original size when it is changed back to a leading channel.

Although FIG. 4 illustrates a two-channel fixed codebook structure, it is appreciated that the concepts are easily generalized to more channels by increasing the number of individual codebooks and the number of lags and inter-channel gains.

The leading and trailing channel fixed codebooks are typically searched in serial order. The preferred order is to first determine the leading channel fixed codebook excitation vector, lags and gains. Thereafter the individual fixed codebook vectors and gains of trailing channels are determined.

Figure 5:
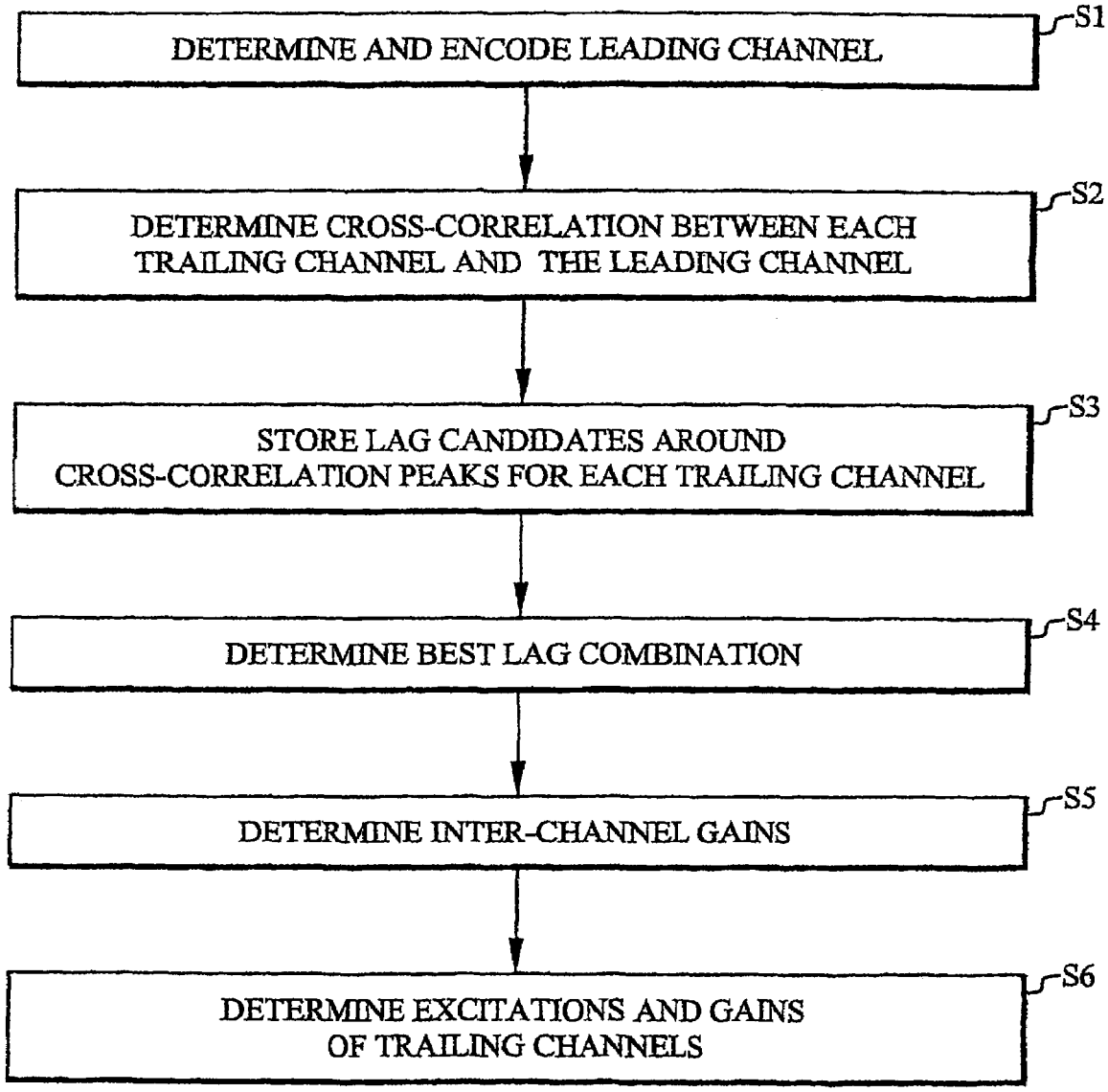
FIG. 5 is a flow chart of an exemplary embodiment of a multi-part fixed codebook search method.

FIG. 5 is a flow chart of an embodiment of a multi-part fixed codebook search method in accordance with the present invention. Step S1 determines and encodes a leading channel, typically the strongest channel (the channel that has the largest frame energy). Step S2 determines the cross-correlation between each trailing channel and the leading channel for a predetermined interval, for example a part of or a complete frame. Step S3 stores lag candidates for each trailing channel. These lag candidates are defined by the positions of a number of the highest cross-correlation peaks and the closest positions around each peak for each trailing channel. One could for instance choose the 3 highest peaks, and then add the closest positions on both sides of each peak, giving a total of 9 lag candidates per trailing channel. If high-resolution (fractional) lags are used the number of candidates around each peak may be increased to, for example, 5 or 7. The higher resolution may be obtained by up-sampling of the input signal. Step S4 selects the best lag combination. Step S5 determines the optimum inter-channel gains. Finally step S6 determines the trailing channel excitations and gains.

For the fixed codebook gains, each trailing channel requires one inter-channel gain to the leading channel fixed codebook and one gain for the individual codebook. These gains will typically have significant correlation between the channels. They will also be correlated to gains in the adaptive codebook. Thus, inter-channel predictions of these gains will be possible.

Returning to FIG. 4, the multi-part adaptive codebook includes one adaptive codebook AC1, AC2 for each channel. A multi-part adaptive codebook can be configured in a number of ways in a multi-channel coder. Examples are:

1. All channels share a single pitch lag. Each channel may have separate pitch gains $g_{A11}$, $g_{A22}$ for improved prediction. The shared pitch lag is searched for in closed loop fashion in the leading (mono) channel and then used in the trailing channels.
2. Each channel has a separate pitch lag $P_{11}$, $P_{22}$. The pitch lag values of the trailing channels may be coded differentially from the leading channel pitch lag or absolutely. The search for the trailing channel pitch lags may be done around the pitch lag value of the leading (mono) channel.
3. The excitation history can be used in a cross-channel manner. A single cross-channel excitation branch can be used, such as predicting channel 2 with the excitation history from leading channel 1 at lag distance $P_{12}$. Synchronously controlled switches SW3, SW4 connect, depending on which channel is leading, the cross-channel excitation to the proper adder AA1, AA2 over a cross-channel gain $g_{A12}$.

As in the case with the fixed codebook, the described adaptive codebook structure is very flexible and suitable for multi-mode operation. The choice whether to use shared or individual pitch lags may be based on the residual signal energy. In a first step the residual energy of the optimal shared pitch lag is determined. In a second step the residual energy of the optimal individual pitch lags is determined. If the residual energy of the shared pitch lag case exceeds the residual energy of the individual pitch lag case by a predetermined amount, individual pitch lags are used. Otherwise a shared pitch lag is used. If desired, a moving average of the energy difference may be used to smoothen the decision.

This strategy may be considered as a "closed-loop" strategy to decide between shared or individual pitch lags. Another possibility is an "open-loop" strategy based on, for example, inter-channel correlation. In this case, a shared pitch lag is used if the inter-channel correlation exceeds a predetermined threshold. Otherwise individual pitch lags are used.

Similar strategies may be used to decide whether to use inter-channel pitch lags or not.

Furthermore, a significant correlation is to be expected between the adaptive codebook gains of different channels. These gains may be predicted from the internal gain history of the channel, from gains in the same frame but belonging to other channels, and also from fixed codebook gains.

In LPC synthesis filter block 12M in FIG. 4 each channel uses an individual LPC (Linear Predictive Coding) filter. These filters may be derived independently in the same way as in the single channel case. However, some or all of the channels may also share the same LPC filter. This allows for switching between multiple and single filter modes depending on signal properties, e.g. spectral distances between LPC spectra. If inter-channel prediction is used for the LSP (Line Spectral Pairs) parameters, the prediction is turned off or reduced for low correlation modes.

Figure 6:
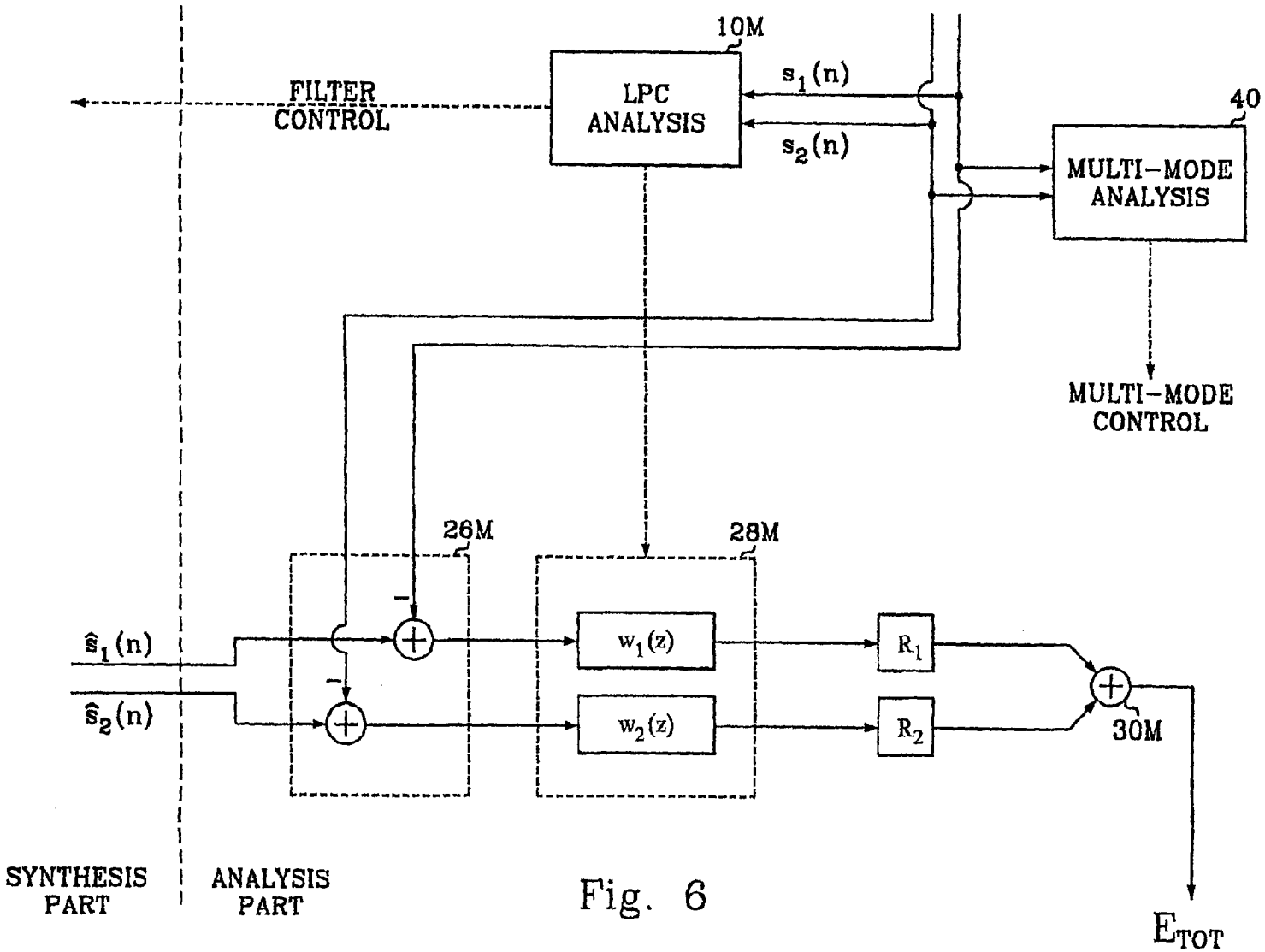
FIG. 6 is a block diagram of an exemplary embodiment of the analysis part of a multi-channel LPAS speech encoder in accordance with the present invention.

FIG. 6 is a block diagram of an exemplary embodiment of the analysis part of a multi-channel LPAS speech encoder in accordance with the present invention. In addition to the blocks that have already been described with reference to FIGS. 1 and 2, the analysis part in FIG. 7 includes a multi-mode analysis block 40. Block 40 determines the inter-channel correlation to determine whether there is enough correlation between the trailing channels and the leading channel to justify encoding of the trailing channels using only the leading channel fixed codebook, lag D and gain $g_{F12}$. If not, it will be necessary to use the individual fixed codebooks and gains for the trailing channels. The correlation may be determined by the usual correlation in the time domain, i.e. by shifting the secondary channel signals with respect to the primary signal until a best fit is obtained. If there are more than two channels, a the leading channel fixed codebook will be used as a shared fixed codebook if the smallest correlation value exceeds a predetermined threshold. Another possibility is to use a shared fixed codebook for the channels that have a correlation to the leading channel that exceeds a predetermined threshold and individual fixed codebooks for the remaining channels. The exact threshold may be determined by listening tests.

The functionality of the various elements of the described embodiments of the present invention are typically implemented by one or several micro processors or micro/signal processor combinations and corresponding software.

In the figures several blocks and parameters are optional and can be used based on the characteristics of the multi-channel signal and on overall speech quality requirement. Bits in the coder can be allocated where they are best needed. On a frame-by-frame basis, the coder may choose to distribute bits between the LPC part, the adaptive and fixed codebook differently. This is a type of intra-channel multi-mode operation.

Another type of multi-mode operation is to distribute bits in the encoder between the channels (asymmetric coding). This is referred to as inter-channel multi-mode operation. An example here would be a larger fixed codebook for one/some of the channels or coder gains encoded with more bits in one channel. The two types of multi-mode operation can be combined to efficiently exploit the source signal characteristics.

The multi-mode operation can be controlled in a closed-loop fashion or with an open-loop method. The closed loop method determines mode depending on a residual coding error for each mode. This is a computationally expensive method. In an open-loop method the coding mode is determined by decisions based on input signal characteristics. In the intra-channel case the variable rate mode is determined based on for example voicing, spectral characteristics and signal energy as described in [4]. For inter-channel mode decisions the inter-channel cross-correlation function or a spectral distance function can be used to determine mode. For noise and unvoiced coding it is more relevant to use the multi-channel correlation properties in the frequency domain. A combination of open-loop and closed-loop techniques is also possible. The open-loop analysis decides on a few candidate modes, which are coded and then the final residual error is used in a closed-loop decision.

Multi-channel prediction (between the leading channel and the trailing channels) may be used for high inter-channel correlation modes to reduce the number of bits required for the multi-channel LPAS gain and LPC parameters.

A technique known as generalized LPAS (see [5]) can also be used in a multi-channel LPAS coder of the present invention. Briefly this technique involves pre-processing of the input signal on a frame by frame basis before actual encoding. Several possible modified signals are examined, and the one that can be encoded with the least distortion is selected as the signal to be encoded.

The description above has been primarily directed towards an encoder. The corresponding decoder would only include the synthesis part of such an encoder. Typically an encoder/decoder combination is used in a terminal that transmits/receives coded signals over a bandwidth limited communication channel. The terminal may be a radio terminal in a cellular phone or base station. Such a terminal would also include various other elements, such as an antenna, amplifier, equalizer, channel encoder/decoder, etc. However, these elements are not essential for describing the present invention and have therefor been omitted.

It will be understood by those skilled in the art that various modifications and changes may be made to the present invention without departure from the scope thereof, which is defined by the appended claims.

REFERENCES

[1] A. Gersho, "Advances in Speech and Audio Compression", Proc. of the IEEE, Vol. 82, No. 6, pp 900-918, June 1994,

[2] A. S. Spanias, "Speech Coding: A Tutorial Review", Proc. of the IEEE, Vol 82, No. 10, pp 1541-1582, October 1994.

[3] WO 00/19413 (Telefonaktiebolaget L M Ericsson).

[4] Allen Gersho et.al, "Variable rate speech coding for cellular networks", page 77-84, Speech and audio coding for wireless and network applications, Kluwer Academic Press, 1993.

[5] Bastiaan Kleijn et.al, "Generalized analysis-by-synthesis coding and its application to pitch prediction", page 337-340, In Proc. IEEE Int. Conf. Acoust., Speech and Signal Processing, 1992.

The invention claimed is:

1. A multi-channel linear predictive analysis-by-synthesis signal encoding method, comprising:

determining a leading channel and at least one trailing channel lagging behind said leading channel;

encoding said leading channel as an embedded bitstream;

encoding trailing channels as a discardable bitstream; and selecting a trailing channel encoding mode depending on inter-channel correlation to said leading channel.

2. The method of claim 1, wherein selectable encoding modes result in a fixed gross bit-rate.

3. The method of claim 1, wherein selectable encoding modes may result in a variable gross bit-rate.

4. The method of claim 1, further comprising:

using channel specific LPC filters for low inter-channel correlation; and sharing said leading channel LPC filter for high inter-channel correlation.

5. The method of claim 1, further comprising:

using channel specific fixed codebooks for low inter-channel correlation; and sharing said leading channel fixed codebook for high inter-channel correlation.

6. The method of claim 5, further comprising:

using an inter-channel lag from said leading channel fixed codebook to each trailing channel.

7. The method of claim 1, further comprising:

adaptively distributing bits between trailing channel fixed codebooks and said leading channel fixed codebook depending on inter-channel correlation.

8. The method of claim 1, further comprising:

using channel specific adaptive codebook lags for low inter-channel correlation; and using a shared adaptive codebook lag for high inter-channel correlation.

9. The method of claim 8, further comprising:

using an inter-channel adaptive code book lag from said leading channel adaptive codebook to each trailing channel.

10. The method in claim 1, wherein the encoding method is performed in a single encoder.

11. A multi-channel linear predictive analysis-by-synthesis signal encoder, comprising electronic circuitry configured to perform the following:

determine a leading channel and at least one trailing channel lagging behind said leading channel;

encode said leading channel as an embedded bitstream;

encode trailing channels as a discardable bitstream; and select a trailing channel encoding mode depending on inter-channel correlation to said leading channel.

12. The encoder of claim 11, further comprising:

channel specific LPC filters for low inter-channel correlation; and a shared leading channel LPC filter for high inter-channel correlation.

13. The encoder of claim 11, further comprising:

channel specific fixed codebooks for low inter-channel correlation; and a shared leading channel fixed codebook for high inter-channel correlation.

14. The encoder of claim 13, further comprising:

an inter-channel lag from said leading channel fixed codebook to each trailing channel.

15. The encoder of any claim 11, wherein the electronic circuitry is further configured to adaptively distribute bits between trailing channel fixed codebooks and said leading channel fixed codebook depending on inter-channel correlation.

16. The encoder of claim 11, further comprising:

channel specific adaptive codebook lags for low inter-channel correlation; and a shared adaptive codebook lag for high inter-channel correlation.

17. The encoder of claim 16, further comprising:

an inter-channel adaptive codebook lag from said leading channel adaptive codebook to each trailing channel.

18. A terminal including a multi-channel linear predictive analysis-by-synthesis signal encoder, further comprising:

means determining a leading channel and at least one trailing channel lagging behind said leading channel;

means for encoding said leading channel as an embedded bitstream;

means for encoding trailing channels as a discardable bitstream; and means for selecting a trailing channel encoding mode depending on inter-channel correlation to said leading channel.

19. The terminal of claim 18, further comprising:

channel specific LPC filters for low inter-channel correlation; and a shared leading channel LPC filter for high inter-channel correlation.

20. The terminal of claim 18, further comprising:

channel specific fixed codebooks for low inter-channel correlation; and a shared leading channel fixed codebook for high inter-channel correlation.

21. The terminal of claim 20, further comprising:

an inter-channel lag from said leading channel fixed codebook to each trailing channel.

22. The terminal of claim 18, further comprising:

means for adaptively distributing bits between trailing channel fixed codebooks and said leading channel fixed codebook depending on inter-channel correlation.

23. The terminal of claim 18, further comprising:

channel specific adaptive codebook lags for low inter-channel correlation; and a shared adaptive codebook lag for high inter-channel correlation.

24. The terminal of claim 23, further comprising:

an inter-channel adaptive codebook lag from said leading channel adaptive codebook to each trailing channel.

* * * * *

UNITED STATES PATENT AND TRADEMARK OFFICE

CERTIFICATE OF CORRECTION

PATENT NO. : 7,263,480 B2
APPLICATION NO. : 10/380419
DATED : August 28, 2007
INVENTOR(S) : Minde et al.

It is certified that error appears in the above-identified patent and that said Letters Patent is hereby corrected as shown below:

In the Claims

In Column 8, Line 55, in Claim 15, after "encoder of" delete "any".

In Column 9, Line 3, in Claim 18, after "means" insert -- for --.

Signed and Sealed this
Third Day of September, 2013

Teresa Stanek Rea
*Acting Director of the United States Patent and Trademark Office*